US010449784B2

(12) United States Patent
Otsuka et al.

(10) Patent No.: US 10,449,784 B2
(45) Date of Patent: Oct. 22, 2019

(54) PRINTING DEVICE AND PRINTING METHOD

(71) Applicant: MIMAKI ENGINEERING CO., LTD., Nagano (JP)

(72) Inventors: Toshiya Otsuka, Nagano (JP); Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/027,253

(22) Filed: Jul. 3, 2018

(65) Prior Publication Data

US 2019/0023029 A1 Jan. 24, 2019

(30) Foreign Application Priority Data

Jul. 18, 2017 (JP) ..... 2017-138762

(51) Int. Cl.
*B41J 11/00* (2006.01)
*B41M 5/00* (2006.01)
*B41M 7/00* (2006.01)

(52) U.S. Cl.
CPC ..... *B41J 11/002* (2013.01); *B41M 5/0011* (2013.01); *B41M 7/009* (2013.01); *B41M 5/0023* (2013.01); *B41M 7/0081* (2013.01)

(58) Field of Classification Search
CPC ..... B41J 11/002; B41J 11/0015; B41J 11/007; B41M 5/0011
USPC ..... 347/101, 102, 104
See application file for complete search history.

(56) References Cited

U.S. PATENT DOCUMENTS 8,342,669 B2 * 1/2013 Faucher ..... C09D 11/101 106/31.6
2007/0046719 A1 * 3/2007 Yamanobe ..... B41J 2/2114 347/21
2014/0354744 A1 * 12/2014 Ohnishi ..... B41J 2/01 347/102
2018/0311969 A1 * 11/2018 Ohnishi ..... B41J 2/21

FOREIGN PATENT DOCUMENTS

JP 2003-191468 7/2003

* cited by examiner

*Primary Examiner* — An H Do
(74) *Attorney, Agent, or Firm* — JCIPRNET

(57) ABSTRACT

To dry ink using a more appropriate method in a case of performing printing using an ink-jet printer of a line system and the like. A printing device that performs printing using an ink-jet system includes: a conveyance driving unit as a conveyance module that conveys a medium; ink-jet heads; and an ultraviolet ray irradiation unit as an energy irradiation module. A length of the ink-jet heads in a width direction of the medium is larger than a width of a region to be printed. Ink ejected from the ink-jet heads is ink that contains an energy ray absorber and a solvent, the ink being fixed to the medium by evaporating the solvent. The ultraviolet ray irradiation unit irradiates the ink adhering onto the medium with ultraviolet rays to volatilize and remove at least part of the solvent contained in the ink.

13 Claims, 3 Drawing Sheets

PRINTING DEVICE AND PRINTING METHOD

CROSS REFERENCE TO RELATED APPLICATIONS

This application claims the priority benefit of Japanese Patent Application No. 2017-138762, filed on Jul. 18, 2017. The entirety of the above-mentioned patent application is hereby incorporated by reference herein and made a part of this specification.

BACKGROUND OF THE DISCLOSURE

Technical Field

The disclosure relates to a printing device and a printing method.

Background Art

In recent years, ink-jet printers are used in various fields. In the related art, as a configuration of the ink-jet printer, there is known a configuration of a line system (configuration of an ink-jet line printer) that performs printing on a medium conveyed by using an ink-jet head (line head) the length of which in a width direction of a medium (recording medium) is longer than that of a region to be printed on the medium (for example, refer to Patent Literature 1). As ink for an ink-jet printer, in the related art, widely used is evaporation drying type ink that fixes to a medium as solvent dries.

In a case of using the evaporation drying type ink for an ink-jet printer of a line system, an infrared heater, a heating roller, and the like are normally used as a drying module for drying ink ejected (printed) on a medium and installed on a downstream side of the ink-jet head in a conveying direction. By heating and drying the ink together with the medium by the drying module immediately after the ink is landed on the medium, the ink is caused to be fixed onto the medium. As a method of drying the ink, for example, there is also known a method of performing heating with a heater (print heater) arranged to be opposed to the ink-jet head. For example, there is known a method of heating and drying the ink using a near infrared lamp in a state of not being in contact with the ink or the medium.

Patent Literature 1: Japanese Unexamined Patent Publication No. 2003-191468

SUMMARY

In a case of drying the ink with an infrared heater, a heating roller, or the like in the ink-jet printer of a line system, temperature of the medium needs to be increased to a reasonably high temperature. For this reason, heating typically needs to be performed at a high temperature. More specifically, in a case of an application for performing high-speed printing (high-speed printer) in which an ink-jet printer of a line system is widely used, a heating temperature needs to be set to be a high temperature of about 200 to 400° C., for example. However, in a case of performing heating at such a high temperature, when the medium is stopped being conveyed due to some troubles, the medium is caused to be in an overheating state, and there may be a risk of ignition and the like.

In a case of performing color printing by using ink of a plurality of colors, for example, in the ink-jet printer of a line system, a plurality of ink-jet heads are arranged side by side along the conveying direction of the medium. In this case, ink ejected to each position on the medium from each ink-jet head needs to be dried by the time when the medium is moved to a position of the next ink-jet head. In this case, when the medium reaches the position of the next ink-jet head while the temperature of the medium remains high, the ink in the ink-jet head may be dried before being ejected therefrom due to influence of heat. As a result, nozzle clogging and the like may be caused, and a problem of ejection failure may be generated. Thus, in this case, between two ink-jet heads continuously arranged side by side, in addition to heating of respective positions of the medium, the temperature of the medium at a present position needs to be sufficiently lowered before the medium reaches the position of the next ink-jet head after heating. On the other hand, in a case of performing heating at a high heating temperature as described above, it takes some time to raise or reduce the temperature. Thus, for example, to increase the conveying speed of the medium for performing printing at high speed and to appropriately heat or cool the medium between the two ink-jet heads continuously arranged side by side, an interval between the ink-jet heads needs to be large. In this case, a size of the device unavoidably has to be increased by extending a line distance, for example.

As a method of drying the ink on the medium, as described above, considered is a method of heating the ink with a heater (print heater) at a position opposed to the ink-jet head, for example. However, in this case, a surface of the ink-jet head is heated at the same time, so that drying of the ink in the ink-jet head is accelerated before the ink being ejected from the ink-jet head. As a result, a problem such as an ejection failure is easily caused. As the method of drying the ink on the medium, as described above, considered is a method of performing heating by using a lamp such as a near infrared lamp. However, in this case, for example, dust particles (for example, paper dust) generated from the medium and surrounding dust may approach or touch the near infrared lamp to cause a fire in some cases. When paper dust, dust, ink, vapor generated from the ink, and the like adhere to a surface of the lamp, heat radiation energy amount of the lamp is lowered, and drying efficiency of the ink on the medium is deteriorated in some cases.

In any case of performing heating using the method described above, heating needs to be performed at a high temperature to perform printing at high speed and improve productivity of printing. In this case, for example, a problem is caused such that required electric power is significantly large. In this case, burns and ignition of the medium due to overheating, or ejection failure of a nozzle in the ink-jet head may be more likely to be caused. To prevent such problem as ignition, for example, a cooling device for emergency, a detector for fire defense, or a fire extinguishing facility needs be installed. As a result, upsizing of the device and significant increase of cost, for example, would become major problems. In a case of performing heating at a high temperature using the method as described above, it takes much time to raise the temperature to a set heating temperature, for example, which may cause a problem of lowered productivity.

Thus, in the related art, in a case of performing printing with an ink-jet printer of a line system and the like, there is a demand for a configuration of drying the ink using a more appropriate method. The disclosure provides a printing device and a printing method for resolving the problems described above.

The inventors of the disclosure have made vigorous investigation as to a method of drying the ink more appropriately in a case of performing printing with an ink-jet printer of a line system and the like. The inventors have conceived to heat the ink more directly instead of heating the ink indirectly by heating the medium as in a configuration in the related art. As a specific method, the inventors have conceived to use ink containing an energy ray absorber that absorbs predetermined energy rays to generate heat, and to cause the ink itself to generate heat by being irradiated with energy rays. Through further vigorous investigation, the inventors found a characteristic required for obtaining such an effect and made the disclosure.

To solve the above problems, the disclosure provides a printing device that performs printing on a medium by using an ink-jet system, the printing device including: a conveyance module, configured to convey the medium in a preset conveying direction; an ink-jet head, configured to eject ink to the medium conveyed by the conveyance module; and an energy irradiation module, configured to apply predetermined energy rays, wherein a length of the ink-jet head in a width direction of the medium as a direction orthogonal to the conveying direction is larger than a width of a region to be printed on the medium in which printing is performed, the ink ejected by the ink-jet head is ink that contains a solvent and an energy ray absorber that generates heat by absorbing the energy rays, and is fixed to the medium by evaporating the solvent, and the energy irradiation module applies the energy rays to the ink adhering onto the medium to volatilize and remove at least part of the solvent contained in the ink.

With this configuration, the ink can be directly heated by causing the ink itself to generate heat instead of indirectly heating the ink by heating the medium. Due to this, for example, the ink can be dried more efficiently without excessively raising the temperature of the medium. In this case, a problem such as ignition and the like can be prevented more appropriately as compared with a case of performing heating at a high temperature with a heater and the like. For example, power consumption can also be reduced appropriately. In this case, the ink can be appropriately dried within a short time, so that the ink can be appropriately dried even in a case in which a conveying speed of the medium is increased, for example.

In this case, the ink can be efficiently dried within a short time and the temperature of the medium may be prevented from being raised, so that, in a case of arranging a plurality of ink-jet heads along the conveying direction of the medium, intervals between the ink-jet heads can be further reduced to prevent the distance of the line from being increased. In this case, only the ink on the medium can be efficiently heated, so that a large-sized cooling device and the like for cooling the medium are not required, for example. A risk of ignition and the like is reduced, so that high safety can be secured even when a detector for fire defense, a fire extinguishing facility, and the like are not provided. Thus, with this configuration, for example, the size of the device can be appropriately prevented from being increased while securing required safety and the like.

With this configuration, the ink is dried by being irradiated with energy rays, so that the ink can be appropriately prevented from being dried at a position where no energy ray is applied. Thus, with this configuration, for example, nozzle clogging can be appropriately prevented from being generated in the ink-jet head. In this case, for example, it is not necessary to wait for raising of temperature of a heater and the like as in a case of performing heating at a high temperature with the heater and the like, for example, printing can be immediately performed after turning on a power supply of the printing device, for example. Thus, with this configuration, for example, productivity of printing can also be improved appropriately.

In this configuration, the printing device is, for example, an ink-jet printer of a line system. In this case, for example, the ink-jet head is arranged so that a longitudinal direction thereof intersects with (for example, at right angles) the conveying direction. As the ink, for example, water-based ink containing an aqueous solvent as a principal component, solvent ink containing an organic solvent as a principal component, and the like may be used.

As an energy irradiation module, for example, a UV light source that applies ultraviolet rays as energy rays may be used. In this case, the ink contains, for example, an ultraviolet ray absorber that absorbs ultraviolet rays as energy ray absorber. With this configuration, for example, the ink can be efficiently and appropriately heated without excessively increasing the temperature of the medium. In this case, as the ultraviolet ray absorber, for example, a benzotriazole-based ultraviolet ray absorber, a liquid ultraviolet ray absorber, a triazine-based ultraviolet ray absorber, a benzophenone-based ultraviolet ray absorber, a benzoate-based ultraviolet ray absorber, a benzimidazole-based ultraviolet ray absorber, or the like may be used. A content of the ultraviolet ray absorber in the ink may be in a range from about 0.05 to 2 weight %, for example. With this configuration, for example, the ink can be efficiently and appropriately dried by applying ultraviolet rays.

As energy rays for drying the ink, energy rays other than ultraviolet rays may be used. For example, infrared rays and the like may be used as energy rays. In this case, the ink contains an infrared ray absorber that absorbs infrared rays as the energy ray absorber. Also with this configuration, the ink can be efficiently and appropriately heated.

As the energy irradiation module, for example, it may be preferable to use an irradiation module and the like using a semiconductor element that generates energy rays. In this case, an LED and the like that emit energy ray having a wavelength corresponding to a characteristic of an energy ray absorber contained in the ink may be used. More specifically, for example, in a case of using ultraviolet rays as energy rays, it may be preferable to use, as the energy irradiation module, an ultraviolet LED (UV LED) and the like that generate ultraviolet rays having a wavelength corresponding to an absorption characteristic of the ultraviolet ray absorber in the ink.

The energy irradiation module is, for example, arranged on a downstream side of the ink-jet head in the conveying direction. With this configuration, for example, energy rays can be applied to a portion moved to the outside of a region opposed to the ink-jet head on the medium. Due to this, the ink-jet head can be more appropriately prevented from being influenced by heating or influenced by the solvent evaporated from the ink. The energy irradiation module irradiates, for example, the ink on the medium with energy rays so that a continuous irradiation time of energy rays for the same position on the medium is smaller than a thermal time constant of heat radiation of the medium. With this configuration, for example, the ink can be efficiently heated within a short time while more appropriately preventing the temperature of the medium from being increased.

The energy irradiation module increases viscosity of the ink by irradiating the ink on the medium with energy rays. In this case, for example, the viscosity of the ink may be increased to a degree such that the ink does not bleed even if the ink is brought into contact with ink of another color, and flattening (smoothing) of dots of the ink proceeds for some time after energy rays are applied. With this configuration, for example, dots of the ink can be appropriately flattened. Due to this, for example, high gloss printing can be performed more appropriately.

More specifically, in this case, for example, a downstream-side heater may be further used, the downstream-side heater serving as a heater that heats the medium on a downstream side of the energy irradiation module in the conveying direction. In this case, for example, the downstream-side heater completely fixes the ink onto the medium by further heating the medium after applying energy rays with the energy irradiation module. In this case, flattening of dots of the ink proceeds during a period in which the medium moves to a position of the downstream-side heater, for example. With this configuration, for example, the ink can be appropriately fixed to the medium while dots of the ink are appropriately flattened. In this case, for example, the downstream-side heater heats the medium so that the temperature of the medium falls within a preset range from 30 to 100° C. With this configuration, for example, the ink can be appropriately fixed to the medium. Also in this case, by suppressing the heating temperature of the medium to be equal to or lower than 100° C., a risk of ignition and the like can be prevented, and heating can be appropriately performed.

The printing device may further include a heater other than the downstream-side heater described above. More specifically, for example, an upstream-side heater and the like may be used, the upstream-side heater serving as a heater that heats the medium on a upstream side of the ink-jet head in the conveying direction. In this case, for example, the upstream-side heater heats the medium so that the temperature of the medium falls within a preset range equal to or lower than 50° C. With this configuration, for example, by adjusting an initial temperature of the medium, influence and the like of an environment temperature can be appropriately prevented. Due to this, for example, high-quality printing can be performed more appropriately. Also in this case, by sufficiently lowering the heating temperature of the medium, a risk of ignition and the like can be prevented, and heating can be appropriately performed.

In a case of performing color printing and the like using ink of a plurality of colors by a printing device, for example, a plurality of ink-jet heads may be used. In this case, the printing device includes, for example, a plurality of ink-jet heads and a plurality of energy irradiation modules. The ink-jet heads are arranged side by side in the conveying direction with a gap therebetween. Each of the energy irradiation modules is arranged between the ink-jet heads in the conveying direction. With this configuration, viscosity of the ink ejected from each ink-jet head to each position on the medium can be appropriately increased before the ink is ejected from the next ink-jet head to the same position. Due to this, for example, printing using the ink of a plurality of colors can be appropriately performed. In this case, it is preferable that printing is performed without heating the medium using a heating module other than the energy irradiation module in a range in which the ink-jet heads are arranged side by side. The heating module other than the energy irradiation module means, for example, a heater that heats the medium by generating heat by itself. With this configuration, the ink can be appropriately dried while preventing the temperature of the medium from being excessively increased.

As a configuration of the disclosure, a printing method and the like having a characteristic similar to that described above may be used. Also in this case, for example, an effect similar to that described above can be obtained.

According to the disclosure, in a case of performing printing with an ink-jet printer of a line system and the like, the ink can be dried using a more appropriate method.

BRIEF DESCRIPTION OF THE DRAWINGS

FIG. 1A is a side view illustrating a configuration example of a principal part of the printing device 10. FIG. 1B is a top view illustrating part of the printing device 10.

DESCRIPTION OF EMBODIMENTS

Figure 1A:
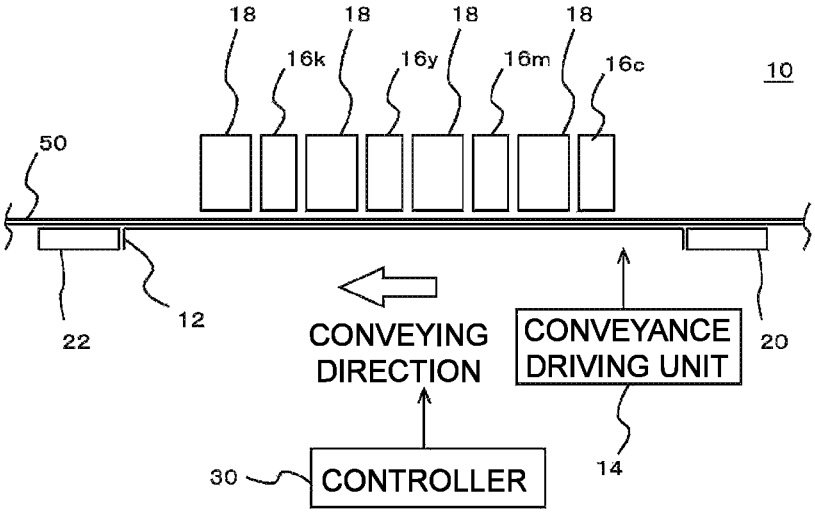
FIG. 1A and FIG. 1B are diagrams illustrating an example of a printing device 10 according to an embodiment of the disclosure.
Figure 1B:
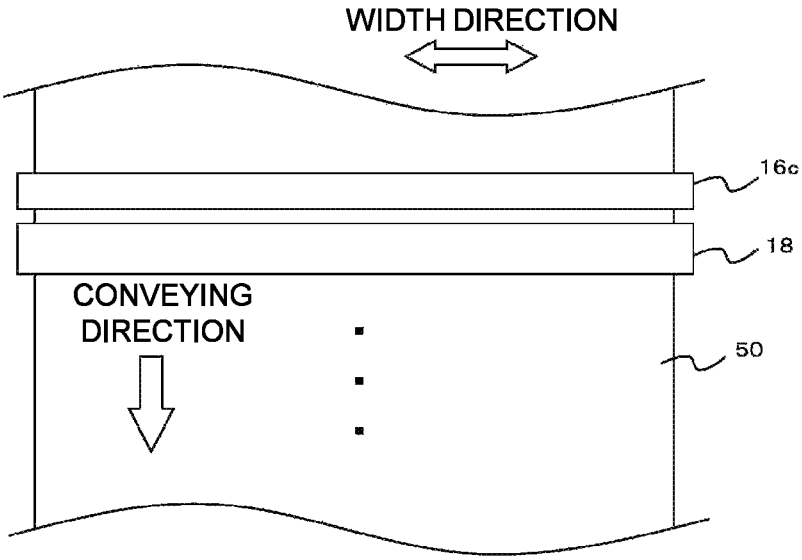

The following describes an embodiment according to the disclosure with reference to the drawings. FIG. 1A and FIG. 1B illustrate an example of a printing device 10 according to the embodiment of the disclosure. FIG. 1A is a side view illustrating a configuration example of a principal part of the printing device 10. FIG. 1B is a top view illustrating part of the printing device 10. In this example, the printing device 10 is an ink-jet printer of a line system, and includes a stage 12, a conveyance driving unit 14, a plurality of ink-jet heads 16*c* to 16*k*, a plurality of ultraviolet ray irradiation units 18, a preheater 20, an after heater 22, and a controller 30.

Except the points described below, the printing device 10 may have a characteristic that is the same as or similar to that of a known printing device. For example, in addition to the configuration described above and described below, the printing device 10 may further have various configurations that are the same as or similar to those of a known ink-jet printer. The printing device 10 according to this example may be considered, for example, to be an image forming device and the like that form an image on a medium 50.

The stage 12 is a table-like member that supports the medium 50 as a printing target. In this example, by placing the medium 50 conveyed in a predetermined conveying direction by the conveyance driving unit 14 on an upper surface of the stage 12, the stage 12 supports the medium 50. The conveyance driving unit 14 is a driving unit that conveys the medium 50 and conveys the medium 50 in the conveying direction represented by an arrow in the drawing by using a roller and the like (not illustrated), for example. In this example, the conveyance driving unit 14 is an example of a conveyance module and continuously drives conveyance of the medium 50 without stopping conveyance during a printing operation by continuously conveying the medium 50 at a certain speed during the printing operation, for example. In this case, "without stopping conveyance during a printing operation" means, for example, not to stop conveyance of the medium 50 during a period in which a sequential printing operation is performed on one medium 50.

The ink-jet heads 16*c* to 16*k* have a configuration of ejecting ink onto the medium 50 conveyed by the conveyance driving unit 14 and eject ink of colors different from each other. More specifically, the ink-jet head 16*c* ejects ink of C (cyan) color. The ink-jet head 16*m* ejects ink of M (magenta) color. The ink-jet head 16*y* ejects ink of Y (yellow) color. The ink-jet head 16*k* ejects ink of K (black) color.

Each of the ink-jet heads 16*c* to 16*k* is an ink-jet head (line head) for the ink-jet printer of a line system and arranged so that a longitudinal direction thereof intersects with the conveying direction. More specifically, in this example, as illustrated in FIG. 1A, the ink-jet heads 16*c* to 16*k* are arranged side by side in the conveying direction with a gap therebetween at positions opposed to the stage 12 across the medium 50. In this case, as illustrated in FIG. 1B, each of the ink-jet heads 16*c* to 16*k* is arranged so that the longitudinal direction thereof is orthogonal to the conveying direction. In this case, by using the ink-jet heads 16*c* to 16*k* with the longitudinal direction of which is longer than the width of the region to be printed on the medium 50 in which printing is performed, the length of the ink-jet heads 16*c* to 16*k* in the width direction of the medium 50 is larger than the width of the region to be printed. In this case, as illustrated in FIG. 1B, the width direction of the medium 50 is a direction orthogonal to the conveying direction. Due to this, the ink-jet heads 16*c* to 16*k* are configured to be able to eject the ink to the width wider than the region to be printed in the width direction of the medium 50.

Each of the ink-jet heads 16*c* to 16*k* includes a plurality of nozzles the positions of which in the width direction of the medium 50 are shifted from each other. In each of the ink-jet heads 16*c* to 16*k*, the nozzles are arranged at regular intervals so that a gap therebetween in the width direction of the medium 50 is equal to a gap corresponding to printing resolution (resolution in the width direction of the medium 50). Due to this, each of the ink-jet heads 16*c* to 16*k* performs printing through 1-pass (single pass) operation by ejecting the ink from a plurality of nozzles onto the medium 50 conveyed by the conveyance driving unit 14. In this case, "performs printing through 1-pass operation" means, for example, to perform printing so that each position on the medium 50 passes through positions opposed to the respective ink-jet heads 16*c* to 16*k* only once. In this case, the respective ink-jet heads 16*c* to 16*k* sequentially eject ink of respective colors to the respective positions on the medium 50 passing through the opposed positions. With this configuration, for example, the ink of respective colors used for color printing can be appropriately ejected to the respective positions on the medium 50.

In this example, each of the ink-jet heads 16*c* to 16*k* ejects evaporation drying type ink to be fixed to the medium 50 by evaporating a solvent. More specifically, as such ink, used is ink containing an ultraviolet ray absorber and a solvent. The ink may further contain various components that are the same as or similar to those of known ink. For example, in this example, the ink of respective colors used in the respective ink-jet heads 16*c* to 16*k* further contains a color material (coloring agent) and the like corresponding to the color of the ink.

In this example, the ultraviolet ray absorber contained in the ink is a substance that absorbs ultraviolet rays to generate heat. In this case, by irradiating the ink with ultraviolet rays, the ink itself generates heat. In this example, at least part of the solvent in the ink is volatilized and removed by utilizing the heat generation. The ultraviolet ray absorber is an example of the energy ray absorber that absorbs energy rays to generate heat. A characteristic of the ink used in this example will be described later in more detail.

The ultraviolet ray irradiation units 18 are UV light sources that function as an example of the energy irradiation module and applies ultraviolet rays as an example of energy rays. In this example, as illustrated in FIG. 1A, each of the ultraviolet ray irradiation units 18 is arranged between any two of the ink-jet heads 16*c* to 16*y* in the conveying direction. In this case, as illustrated in FIG. 1B, each of the ultraviolet ray irradiation units 18 is arranged in an orientation such that the longitudinal direction thereof is orthogonal to the conveying direction. In this case, by using the ultraviolet ray irradiation unit 18 the longitudinal direction of which is longer than the width of the region to be printed on the medium 50, ultraviolet rays can be applied to a width wider than the region to be printed in the width direction of the medium 50.

With this configuration, in this example, each ultraviolet ray irradiation unit 18 is arranged on a downstream side of the respective ink-jet heads 16*c* to 16*k* in the conveying direction. The ultraviolet ray irradiation unit 18 irradiates the ink adhering onto the medium 50 with ultraviolet rays to cause the ink to generate heat. Due to this heat, at least part of the solvent contained in the ink is volatilized and removed. With this configuration, viscosity of the ink ejected from each of the ink-jet heads 16*c* to 16*k* to each position on the medium 50 can be appropriately increased before the ink is ejected from the next ink-jet head to the same position. Due to this, for example, printing with the ink of a plurality of colors can be appropriately performed.

In this case, each ultraviolet ray irradiation unit 18 irradiates, with ultraviolet rays, a portion of the medium 50 moved to the outside of regions opposed to the respective ink-jet heads 16*c* to 16*k*. Thus, according to this example, the ink-jet heads 16*c* to 16*k* can be appropriately prevented from being influenced by heating, for example. More specifically, in this case, influence of heat on nozzle faces of the ink-jet heads 16*c* to 16*k* can be appropriately reduced as compared with a case of heating the medium 50 with a heater (print heater) and the like at the positions opposed to the ink-jet heads 16*c* to 16*k*, for example. In this case, ultraviolet rays are not applied to the nozzle face, so that the ink on the nozzle face is not directly dried by being irradiated with ultraviolet rays. Thus, according to this example, nozzle clogging and the like can be appropriately prevented from being caused due to drying of the ink on the nozzle face, for example. In this case, for example, a position at which the ink is evaporated on the medium 50 is shifted from the positions of the ink-jet heads 16*c* to 16*k* in the conveying direction, so that influence and the like of the solvent evaporated from the ink can be appropriately prevented. For example, "influence of the solvent evaporated from the ink" is influence that is caused when the evaporated solvent coagulates on the nozzle face.

As the ultraviolet ray irradiation unit 18, for example, it is preferable to use an irradiation module using a semiconductor element that generates ultraviolet rays. In this case, for example, an LED (UV LED) and the like may be used, the LED (UV LED) applying ultraviolet rays having a wavelength corresponding to a characteristic of the ultraviolet ray absorber contained in the ink. In this example, by drying the ink using the ultraviolet ray irradiation unit 18, various effects can be obtained in addition to the effects described above. Such effects will be described later in more detail.

The preheater 20 is a heating module for performing preheating before the ink is ejected to each position on the medium 50. In this example, the preheater 20 is an example of the upstream-side heater, which is arranged on a upstream side (the most upstream) of the ink-jet heads 16*c* to 16*k* in the conveying direction of the medium 50 to preheat the medium 50.

In this case, a region of the medium 50 in which the ink is not ejected is heated, so that heating cannot be performed by applying ultraviolet rays like the ultraviolet ray irradiation unit 18. Thus, as the preheater 20, for example, it is preferable to use a heating device that heats the medium 50 by generating heat by itself. More specifically, as the preheater 20, it is preferable to use various known heaters, for example. In this example, for example, the preheater 20 is a heater for suppressing influence and the like of environment temperature by adjusting the temperature of the medium 50 to be a certain temperature (initial temperature). In this case, for example, the preheater 20 heats the medium 50 so that the temperature of the medium 50 falls within a present range equal to or lower than 50° C. (for example, about 30 to 50° C., preferably, about 35 to 45° C.). With this configuration, for example, influence and the like of the environment temperature can be appropriately prevented. Due to this, for example, unevenness in a manner of evaporating the solvent can be suppressed, and high-quality printing can be performed more appropriately. In this example, as illustrated in FIG. 1A for example, the preheater 20 is arranged at a position outside the stage 12 opposed to the medium 50. With this configuration, for example, by heating the medium 50 at a position sufficiently distant from the ink-jet heads 16*c* to 16*k*, the medium 50 can be appropriately heated while influence on the ink-jet heads 16*c* to 16*k* is appropriately suppressed.

The after heater 22 is a heating module (heating device) for further heating the ink on the medium 50 after irradiation of ultraviolet rays by the ultraviolet ray irradiation units 18 and heats the medium 50 on a downstream side of the ink-jet heads 16*c* to 16*k* and the ultraviolet ray irradiation units 18 in the conveying direction of the medium 50. Due to this, in a case in which the ink is not completely dried only by being heated by the ultraviolet ray irradiation units 18 and part of the solvent in the ink remains, for example, the after heater 22 volatilizes and removes the remaining solvent and completely fixes the ink onto the medium 50. In this example, the after heater 22 is an example of the downstream-side heater, and heats the medium 50 so that the temperature of the medium 50 falls within a preset range from 30 to 100° C. With this configuration, for example, fixing of the ink onto the medium 50 can be completed more securely.

In this example, as illustrated in FIG. 1A for example, the after heater 22 is also arranged at a position opposed to the medium 50 outside the stage 12. With this configuration, for example, by heating the medium 50 at a position sufficiently distant from the ink-jet heads 16*c* to 16*k*, the medium 50 can be appropriately heated while influence on the ink-jet heads 16*c* to 16*k* is appropriately suppressed. An installation position of the after heater 22 may be, for example, a position on the most downstream in the conveying direction. For example, the installation position may be further downstream of the most downstream ultraviolet ray irradiation unit 18.

The controller 30 is a CPU of the printing device 10, for example, and controls operations of components of the printing device 10. According to this example, for example, printing on the medium 50 can be appropriately performed.

Subsequently, the following describes various effects and the like obtained through the configuration according to the example in more detail. As described above, in this example, by performing heating with the ultraviolet ray irradiation unit 18 using the ink containing the ultraviolet ray absorber, for example, the ink itself can generate heat to directly heat the ink instead of indirectly heating the ink by heating the medium 50. Due to this, for example, the ink can be dried more efficiently and appropriately without excessively increasing the temperature of the medium 50.

In this case, the ink can be appropriately dried without performing high temperature heating (for example, heating at a temperature equal to or higher than 200° C.) with a heater, for example. Even in a case of using a heater such as the preheater 20 or the after heater 22, the heating temperature can be suppressed to be low. Thus, according to this example, for example, even when a printing operation is stopped due to clogging of the medium 50 (a paper jam) or a power failure, overheating of the medium 50 can be appropriately suppressed, and a problem such as ignition can be appropriately prevented. Due to this, for example, even when an emergency such as stoppage of the printing operation occurs, safety can be appropriately secured.

In this case, as compared with a case of performing high temperature heating with a heater, for example, power consumption in the printing operation of the printing device 10 can be reduced. For example, the ink can be appropriately dried within a short time, so that the ink can be appropriately dried even when the conveying speed of the medium 50 is increased. Due to this, for example, the printing speed can be further increased.

As described above, in this example, the ink can be efficiently dried within a short time while suppressing temperature rise of the medium 50. In this case, the ink-jet heads 16*c* to 16*k* arranged along the conveying direction can be arranged at smaller intervals as compared with a configuration of a line system in the related art, for example. Thus, according to this example, for example, a route (line) on which the medium 50 is conveyed can be prevented from being prolonged, and the configuration of the printing device 10 can be downsized.

In this example, only the ink on the medium 50 can be efficiently heated as described above, so that a large-sized cooling device and the like for cooling the medium 50 are not required, for example. In this case, a risk of ignition and the like is reduced, so that high safety can be appropriately secured even when a detector for fire defense, a fire extinguishing facility, and the like are not provided. Thus, according to this example, for example, the printing device 10 can be appropriately downsized while securing required safety and the like. The ultraviolet ray irradiation unit 18 used in this example can be appropriately downsized as compared with a pressurizing and heating roll used in a known line-type configuration. Thus, also from this viewpoint, the printing device 10 can be downsized more easily and appropriately.

In a case of using the ultraviolet ray irradiation unit 18 according to this example, influence on the medium 50 caused by heating can be reduced by directly heating the ink as described above. In this case, by heating the ink in a non-contact state with the medium 50, influence on the medium 50 caused by heating can be further reduced. Thus, according to this example, printing can be performed more appropriately even in a case of using the medium 50 having low heat resistance, for example. Due to this, as compared with a configuration in the related art, for example, a wider variety of media 50 can be used without limitation.

In this case, various types of ink may be used by adding the ultraviolet ray absorber to the ink. More specifically, as the ink, for example, water-based ink containing an aqueous solvent as a principal component may be used. In this case, the principal component means, for example, a component the content of which is the largest in a weight ratio. As the water-based ink, it can be preferable to use various types of ink such as ink further containing resin and the like (for example, latex ink). As the ink, a solvent ink and the like containing an organic solvent as a principal component may be used. Thus, according to this example, regarding the ink, as compared with a configuration in the related art, a wider variety of media 50 can be used without limitation.

In a case of heating the ink by applying ultraviolet rays as in this example, it is not necessary to wait until the temperature of the heater and the like is raised like in a case of performing high temperature heating with the heater and the like, for example. The preheater 20 and the after heater 22 have a configuration of performing low temperature heating as described above, so that a long preheating time is not required. Thus, according to this example, the preheating time and the like of the heater can be appropriately shortened, for example. Due to this, for example, printing can be performed immediately after the power supply of the printing device is turned on. Thus, according to this example, for example, productivity of printing can be increased more appropriately. In this case, a long preheating time and the like are not required, so that, even in a case of changing content to be printed or the medium 50 to be used, for example, the next printing can be started within a short time after a required change is made. Thus, in this case, for example, low-volume high-variety production can be performed more efficiently.

As described above, in this example, after volatilizing and removing at least part of the solvent in the ink using the ultraviolet ray irradiation unit 18, the medium 50 is further heated by using the after heater 22. In this case, for example, high gloss printing can be performed by appropriately flattening (smoothing) dots of the ink formed on the medium 50.

More specifically, in this case, each ultraviolet ray irradiation unit 18 volatilizes and removes only part of the solvent by irradiating, with ultraviolet rays, the ink ejected onto the medium 50 by the ink-jet head (any of the ink-jet heads 16*c* to 16*k*) of immediate upstream of the ultraviolet ray irradiation unit 18, for example. Due to this, the ink on the medium 50 is not completely dried and caused to be in a state in which flattening proceeds with a lapse of time. More specifically, by irradiating the ink on the medium 50 with ultraviolet rays, for example, the ultraviolet ray irradiation unit 18 increases the viscosity of the ink to be in a state that the ink does not bleed even when the ink is brought into contact with ink of another color, and that flattening of dots of the ink proceeds on the medium 50 during conveyance thereafter. In this case, "during conveyance thereafter" means a period in which the medium 50 moves to the position of the after heater 22 after ultraviolet rays are applied, for example. In this case, flattening does not necessarily proceed in the entire period until the medium 50 reaches the position of the after heater 22, and flattening may proceed in a range in which required flatness is obtained until reaching the middle thereof. According to this example, for example, dots of the ink can be appropriately flattened. In this case, by not completely drying the ink by the ultraviolet ray irradiation unit 18, for example, layers of the ink sequentially formed by the respective ink-jet heads 16*c* to 16*k* can be better settled. Additionally, by heating the medium 50 by the after heater 22 after applying ultraviolet rays by the ultraviolet ray irradiation unit 18, the ink can be appropriately fixed to the medium 50.

Figure 2:
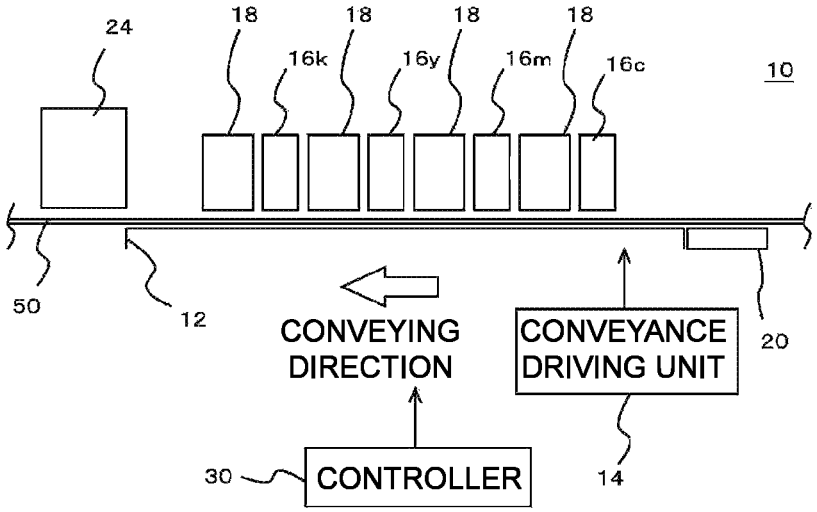
FIG. 2 is a diagram illustrating a modification of a configuration of the printing device 10.

According to a modification of the configuration of the printing device 10, heating for completely fixing the ink onto the medium 50 may be performed by applying ultraviolet rays without using the after heater 22. FIG. 2 is a diagram illustrating the modification of the configuration of the printing device 10. Except the points described below, in FIG. 2, a configuration denoted by the same reference numeral as that in FIG. 1 may have a characteristic that is the same as or similar to the configuration in FIG. 1.

In the present modification, the printing device 10 includes an ultraviolet ray irradiation unit 24 in place of the after heater 22 (refer to FIG. 1) in the configuration illustrated in FIG. 1. The ultraviolet ray irradiation unit 24 is a light source that generates ultraviolet rays on a downstream of the ink-jet heads 16*c* to 16*k* in the conveying direction of the medium 50 and applies ultraviolet rays stronger than that of the ultraviolet ray irradiation unit 18 to completely dry the ink at the most downstream position in the conveying direction, for example. In this case, "applies stronger ultraviolet rays" means, for example, to apply ultraviolet rays so that an integrated amount of applied ultraviolet rays is further increased.

In this case, the ultraviolet ray irradiation unit 18 arranged on an immediately downstream of the respective ink-jet heads 16*c* to 16*k* in the conveying direction volatilizes and removes part of the solvent in the ink, in a range in which the ink is not completely dried, by applying ultraviolet rays weaker than that of the ultraviolet ray irradiation unit 24, for example. In this case, "applying weaker ultraviolet rays" means, for example, to apply ultraviolet rays so that the integrated amount of applied ultraviolet rays becomes smaller. More specifically, in the present modification, by applying weak ultraviolet rays, each ultraviolet ray irradiation unit 18 increases the viscosity of the ink to be in a state that the ink does not bleed even when the ink on the medium 50 is brought into contact with ink of another color, and that flattening of dots of the ink proceeds on the medium 50 during conveyance thereafter. Due to this, the ink on the medium 50 is not completely dried and caused to be in a state in which flattening proceeds with a lapse of time.

In the present modification, by arranging the ultraviolet ray irradiation unit 24 at the most downstream position in the conveying direction, the ink can be securely and appropriately dried without heating the medium 50 at a high temperature, for example. In this case, in a period until each position on the medium 50 reaches the position of the ultraviolet ray irradiation unit 24, the ink can be appropriately dried even when an amount of the solvent in the ink is larger than that in a case of using the printing device 10 having a configuration of FIG. 1A and FIG. 1B, for example. In this case, the ultraviolet ray irradiation unit 18 according to the present modification may apply ultraviolet rays weaker than that of the ultraviolet ray irradiation unit 18 having the configuration of FIG. 1A and FIG. 1B, for example. With this configuration, for example, higher gloss printing and the like can be performed by further flattening (smoothing) dots of the ink formed on the medium 50. Also in this case, by not completely drying the ink by the ultraviolet ray irradiation unit 18, for example, layers of the ink sequentially formed by the respective ink-jet heads 16*c* to 16*k* can be better settled.

In the present modification, the ultraviolet ray irradiation unit 18 can be considered to be an ultraviolet ray irradiation unit arranged on the downstream of one ink-jet head (each of the ink-jet heads 16*c* to 16*k*) in the conveying direction, for example. The ultraviolet ray irradiation unit 24 can be considered to be an ultraviolet ray irradiation unit arranged on the downstream of a plurality of ink-jet heads (ink-jet heads 16*c* to 16*k*) in the conveying direction, for example. According to a further modification of the configuration of the printing device 10, some of the ultraviolet ray irradiation units 18 may be omitted, for example. In this case, more specifically, for example, the ultraviolet ray irradiation unit 18 on the further downstream of the ink-jet head 16*k* may be omitted, the ink-jet head 16*k* being arranged on the most downstream in the conveying direction among the ink-jet heads 16*c* to 16*k*. Also in this case, for example, by applying ultraviolet rays by the ultraviolet ray irradiation unit 24 on the downstream of the ink-jet head 16*k*, the ink ejected from the ink-jet head 16*k* can also be appropriately dried. Depending on characteristics of the medium 50 and the ink, required printing quality, and the like, another ultraviolet ray irradiation unit 18 may be omitted.

Subsequently, the following describes characteristics of the ink used in the configurations described above (hereinafter, referred to as ink in this example) in more detail. As described above, the ink in this example contains the ultraviolet ray absorber. In this case, as the ultraviolet ray absorber, it is preferable to use a substantially colorless substance not to influence the color of the ink. More specifically, as the ultraviolet ray absorber, for example, a benzotriazole-based ultraviolet ray absorber, a liquid ultraviolet ray absorber, a triazine-based ultraviolet ray absorber, a benzophenone-based ultraviolet ray absorber, a benzoate-based ultraviolet ray absorber, a benzimidazole-based ultraviolet ray absorber, or the like may be used.

As the ink containing the ultraviolet ray absorber, there is known UV curable ink that is cured by being irradiated with ultraviolet rays in the related art. In this case, the UV curable ink contains the ultraviolet ray absorber as a polymerization initiator, for example. However, as described above, a reaction of the ink in this example caused by application of ultraviolet rays is not curing and the like due to polymerization but a reaction of volatilizing and removing at least part of the solvent by heat generation. Thus, composition of the ink in this example is largely different from that of UV curable ink in the related art. More specifically, the UV curable ink necessarily contains a monomer, an oligomer, or the like to cause a polymerization reaction. In contrast, such a substance is not required for the ink in this example. Thus, the ink in this example can be considered to be ink containing the ultraviolet ray absorber and not containing a monomer, an oligomer, and the like, for example. In this case, "not containing a monomer, an oligomer, and the like" means not to substantially contain a monomer, an oligomer, and the like for curing the ink. Thus, for example, a configuration in which a minute amount of monomer, oligomer, and the like is added so as to cause a component of the ink to be formally different from that of the ink in this example can be considered to be ink that does not substantially contain a monomer, an oligomer, and the like.

Due to a difference between the characteristics of the ink as described above, a preferred content and the like of the ultraviolet ray absorber are also different between the ink in this example and the UV curable ink. Thus, the following describes such points in more detail.

Figure 3:
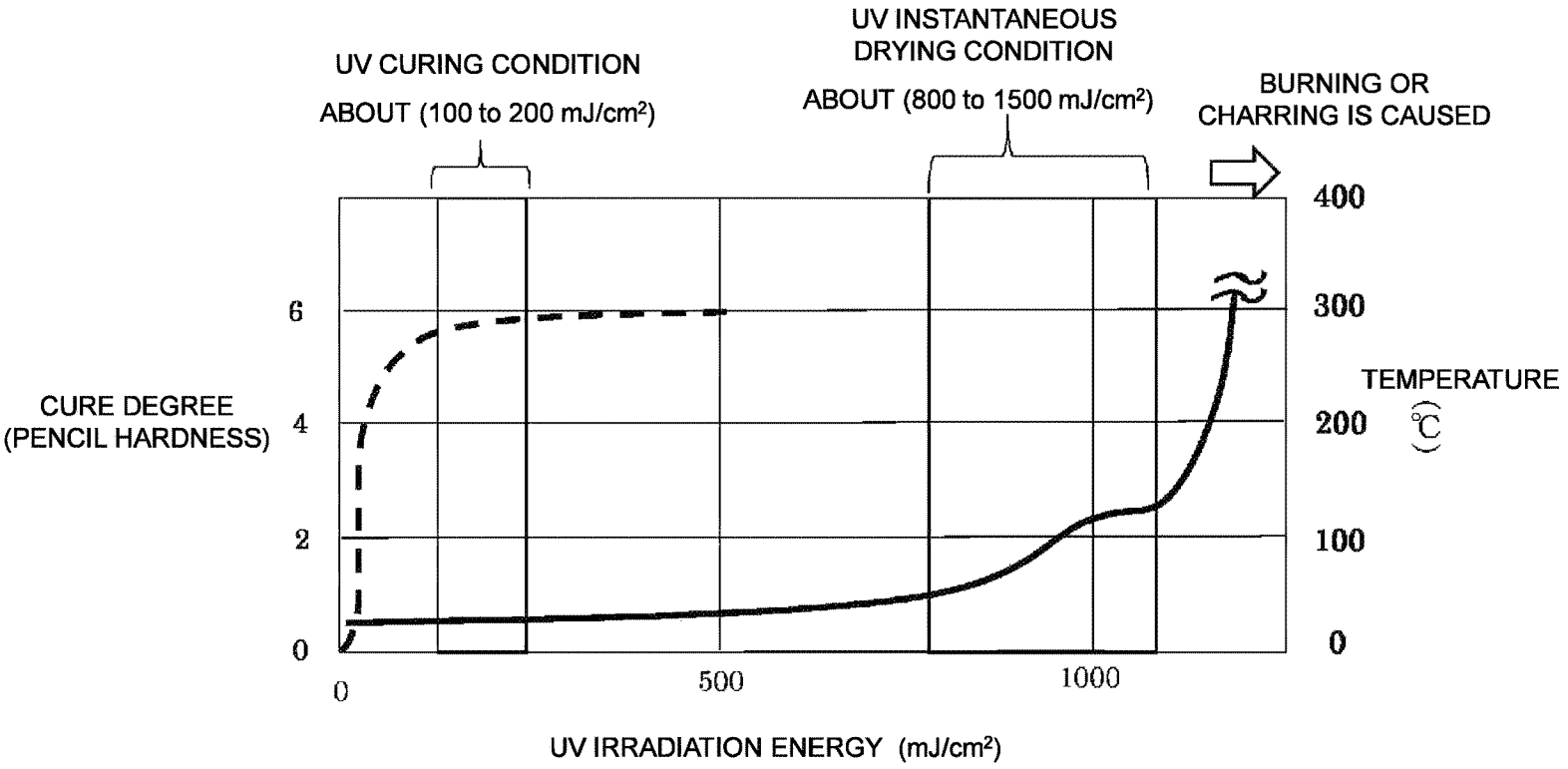
FIG. 3 is a diagram for explaining a condition and the like for drying ink by applying ultraviolet rays.

FIG. 3 is a diagram for explaining a condition and the like for drying the ink by applying ultraviolet rays and illustrates a condition for instantaneously drying the ink by applying ultraviolet rays (UV instantaneous drying condition) in comparison with a condition for curing the ink using known UV curable ink (UV curing condition). In the graph illustrated in the drawing, a curved line represented by a solid line indicates an example of a relation between energy for applying ultraviolet rays (UV irradiation energy) and a temperature of the ink illustrated on the right side of the graph in a case of instantaneously drying the ink by applying ultraviolet rays. In this case, "energy for applying ultraviolet rays" means energy of ultraviolet rays that are applied to the ink on the medium using a UV light source such as a UV LED (magnitude of energy per unit area). The curved line represented by a dashed line indicates an example of a relation between energy for applying ultraviolet rays and a cure degree illustrated on the left side of the graph regarding the known UV curable ink.

As described above, in a case of instantaneously drying the ink by applying ultraviolet rays, a phenomenon caused by applying ultraviolet rays is completely different from a phenomenon in a case of curing the UV curable ink. Thus, a preferable range of the energy for applying ultraviolet rays is also different therebetween. More specifically, in a case of curing the UV curable ink, the preferable range of the energy for applying ultraviolet rays is, for example, about 100 to 200 mJ/cm$^2$ (about 0.1 to 0.2 J/cm$^2$) as illustrated in the drawing. On the other hand, in a case of instantaneously drying the ink by applying ultraviolet rays, the preferable range of the energy for applying ultraviolet rays is, for example, about 800 to 1500 mJ/cm$^2$ (about 0.8 to 1.5 J/cm$^2$). Thus, in the case of instantaneously drying the ink by applying ultraviolet rays, it is preferable to apply large energy that is about ten times the energy in the case of curing the UV curable ink.

As described above, in a case in which dots of the ink are desired to be further flattened (smoothed), for example, there is a case in which only part of the solvent in the ink is evaporated by intentionally applying weak ultraviolet rays by the ultraviolet ray irradiation unit 18 (refer to FIG. 1A and FIGS. 1B and 2). Thus, examples of the integrated amount of ultraviolet rays applied by the ultraviolet ray irradiation unit 18 can be more generalized to be, for example, equal to or larger than about 500 mJ/cm$^2$ (about 0.5 J/cm$^2$), and preferably, equal to or larger than about 800 mJ/cm$^2$ (about 0.8 J/cm$^2$). With this configuration, for example, the ink can be uniformly and appropriately dried. In this case, the integrated amount of ultraviolet rays can be adjusted by controlling, for example, a distance between the ultraviolet ray irradiation unit 18 and the medium 50 or the conveying speed of the medium 50.

In a case of instantaneously drying the ink by applying ultraviolet rays, temperature rise of the ink is stopped around a boiling point of the solvent during a period in which the solvent in the ink is being evaporated. However, when ultraviolet rays are continuously applied after the ink is completely dried, the temperature of the ink is largely increased, and burning or charring of the ink or the medium may be caused. Thus, in the case of instantaneously drying the ink by applying ultraviolet rays, the ink needs to be heated so that such burning or charring is not caused. To heat the ink as described above, for example, it is preferable to prevent only the surface of the ink from being dried and heat the entire ink at the same time if possible. In this case, to prevent only the surface of the ink is dried, it is preferable to cause the content of the ultraviolet ray absorber in the ink to be smaller than a content of the initiator in the UV curable ink, for example, as described below.

More specifically, as described above, in a case of drying the ink by applying ultraviolet rays, it is preferable to instantaneously dry the ink by applying strong ultraviolet rays having large energy per unit area. However, in a case in which concentration of the ultraviolet ray absorber is high, the ultraviolet rays applied to the ink on the medium 50 are intensively absorbed only near the surface of the layer of the ink. In this case, the temperature of only the surface of the layer is rapidly increased due to the applied strong ultraviolet rays, and only the surface is dried. In this case, the inside of the layer of the ink is not dried, so that it is necessary to further apply ultraviolet rays to completely dry the ink. However, when the strong ultraviolet rays are further applied in a state in which the solvent on the surface of the layer of the ink is evaporated, burning and the like are easily caused. In this case, only the surface of the layer of the ink is dried, so that the layer of the ink is caused to be in a state in which a coating is formed on the surface, for example. In this case, the coating covers the ink inside the layer of the ink, so that the solvent in the inside ink is inhibited from being dried. Thus, in this case, even when ultraviolet rays are continuously applied after the surface of the layer of the ink is dried, a state in which the solvent remains inside continues for a long time, and the ink is hardly dried within a short time.

On the other hand, in a case in which the concentration of the ultraviolet ray absorber is low, the amount of ultraviolet rays absorbed on the surface of the layer of the ink is reduced, so that ultraviolet rays reach the inside of the layer. In this case, ultraviolet rays are absorbed by the entire layer of the ink. As a result, the temperature of the layer of the ink is increased more uniformly as a whole. In this way, in a case in which the concentration of the ultraviolet ray absorber is low, the entire layer of the ink can be heated uniformly and appropriately. This enables, for example, the entire layer of the ink to dry instantaneously and appropriately by applying strong ultraviolet rays. More specifically, the content of the ultraviolet ray absorber in the ink may be, for example, 0.01 to 10 weight % with respect to the total weight of the ink. The content of the ultraviolet ray absorber is preferably 0.05 to 2 weight %, more preferably 0.05 to 1 weight %, and especially preferably 0.1 to 0.4 weight %.

Mainly described in the above description is a case in which, for the ultraviolet ray absorber, another substance is added to the ink in addition to an original component of the ink. In this case, the "original component of the ink" means, for example, a component that performs a function of the ink other than a function of heating the ink by applying ultraviolet rays. In this case, as the ultraviolet ray absorber, as described above, it is preferable to use a substantially colorless substance not to influence the color of the ink. In this case, a preferable content of the ultraviolet ray absorber is the content as described above.

In a modification of the configuration of the ink, at least part of the original component of the ink may also have a function as the ultraviolet ray absorber instead of adding the ultraviolet ray absorber to the original component of the ink. For example, in a case of using a carbon pigment and the like as a color material of black ink, the color material itself has an absorption characteristic that is strong in an ultraviolet region. Many of pigments for cyan color or magenta color have the absorption characteristic that is strong in the ultraviolet region. In such a case, if the color material is irradiated with ultraviolet rays and sufficiently generates heat to perform a function as the ultraviolet ray absorber, another substance is not necessarily added as the ultraviolet ray absorber. Considering the above point more generally, for example, in a case in which any (one or more) of the components of the ink such as a color material, resin, or a solvent sufficiently absorbs ultraviolet rays and generates heat, the component can be considered to also function as the ultraviolet ray absorber. That is, "the ink contains the ultraviolet ray absorber" may mean that the ink contains such a component.

In a case in which any of original components of the ink also functions as the ultraviolet ray absorber, the content of the ultraviolet ray absorber contained in the ink is equal to the content (weight %) of the component (for example, an additive such as a color material). The content of the ultraviolet ray absorber in such a case may be different from a preferred content in a case of adding the ultraviolet ray absorber other than the original component of the ink. More specifically, in a case in which any of the original components of the ink also functions as the ultraviolet ray absorber, the content of the ultraviolet ray absorber contained in the ink may largely exceed 1 weight %, for example.

As described above, a substance that absorbs ultraviolet rays is contained in a known UV curable ink as a polymerization initiator, for example. However, a preferable range of the content of the ultraviolet ray absorber in a case of instantaneously drying the ink by applying ultraviolet rays is different from a preferable range of the content of the initiator and the like in the UV curable ink. In this case, the preferable range of the content of the ultraviolet ray absorber means, for example, a preferable range of the content in a case of adding the ultraviolet ray absorber other than the original component of the ink. More specifically, in a case of evaporating the solvent in the ink by applying ultraviolet rays, as described above, temperature rise of the ink is stopped around a boiling point of the solvent during a period in which the solvent remains in the ink. Thus, in this case, even if strong ultraviolet rays are applied, burning and the like of the ink can be appropriately prevented. On the other hand, in a case of applying ultraviolet rays to the UV curable ink, if strong ultraviolet rays are applied, the temperature is largely increased immediately, and burning and the like of the ink are easily caused.

Thus, in a case of applying ultraviolet rays to the UV curable ink, normally, as represented in the graph in the drawing as the UV curing condition, weaker ultraviolet rays are applied. In this case, to appropriately cure the ink by applying ultraviolet rays, the concentration of the polymerization initiator needs to be sufficiently high. In this case, the energy of the applied ultraviolet rays is small, so that burns and the like of the ink is not caused even when the ultraviolet rays are intensively absorbed only near the surface. In a case of using ink of radical polymerization type as the UV curable ink, for example, it is preferable to cure the surface of the layer of the ink at an initial stage to avoid a curing failure caused by surrounding oxygen. With this configuration, for example, sensitivity of curing can be appropriately increased. In this case, also from this viewpoint, it is preferable to increase the concentration of the polymerization initiator.

In this way, the preferable range of the content of the ultraviolet ray absorber in a case of instantaneously drying the ink by applying ultraviolet rays is different from the preferable range of the polymerization initiator in the UV curable ink depending on a difference in a required condition. As a result, the content of the ultraviolet ray absorber in a case of instantaneously drying the ink by applying ultraviolet rays is preferably smaller than the content of the polymerization initiator in the UV curable ink as described above.

Subsequently, the following provides supplementary explanation and the like related to the respective configuration described above. As described above, in a case of drying the ink by applying ultraviolet rays, attention should be made so that burns and the like are not caused in the ink or the medium 50. In this case, it is desirable to cause time for continuously applying ultraviolet rays to the same position on the medium 50 to be in a range in which a large amount of heat is not accumulated in the medium 50. More specifically, in this case, it is preferable to apply ultraviolet rays to the ink on the medium 50 by the ultraviolet ray irradiation unit 18 so that continuous irradiation time of ultraviolet rays for the same position on the medium 50 is shorter than a thermal time constant of heat radiation of the medium 50, for example. With this configuration, for example, the temperature of the medium 50 can be more securely prevented from being excessively increased, and the ink can be efficiently heated within a short time. In this case, the continuous irradiation time of ultraviolet rays can be appropriately adjusted by changing the width of the ultraviolet ray irradiation unit 18 in the conveying direction or conveying speed of the medium 50, for example.

As described above, as the ultraviolet ray irradiation unit 18, for example, it is preferable to use an irradiation module including a semiconductor element such as a UV LED. With this configuration, for example, the ultraviolet ray irradiation unit 18 is caused to efficiently generate ultraviolet rays, and running cost of printing can be appropriately reduced. It is preferable to use the UV LED and the like for preventing ignition that is caused when conveyance of the medium 50 is stopped, for example, and for securing safety of an operator of the printing device 10. As such a UV LED, for example, a known UV LED can be preferably used such as an LED having a wavelength of 365 nm, and an LED having a wavelength of 385 nm. For example, in a case of using a high-output UV LED, an LED having a wavelength of 385 nm that can be more easily acquired may be used. If a required output can be obtained, for example, an LED for deep ultraviolet rays having a wavelength equal to or smaller than 350 nm may be used. Depending on a use of the printing device 10, for example, a metal halide lamp and the like may be used as the ultraviolet ray irradiation unit 18.

In each configuration described above, the various effects described above are obtained by directly heating the ink by the ultraviolet ray irradiation unit 18 instead of heating the medium 50 with a heater and the like in the vicinity of the ink-jet heads 16*c* to 16*k* (refer to FIG. 1A and FIGS. 1B and 2). Thus, to obtain such an effect more appropriately, it is preferable to perform printing in a range in which the ink-jet heads 16*c* to 16*k* are arranged side by side without heating the medium 50 using a heating module other than the ultraviolet ray irradiation unit 18. In this case, the heating module other than the ultraviolet ray irradiation unit 18 means, for example, a heater that generates heat by itself to apply heat to the medium 50. Such a configuration can be considered to be a configuration in which a heater (a print heater and the like) is not arranged on the stage 12 (refer to FIG. 1A and FIGS. 1B and 2) opposed to the ink-jet heads 16*c* to 16*k*, for example. With this configuration, for example, the ink can be appropriately dried while preventing the temperature of the medium 50 from being excessively increased. Due to this, for example, as described above, nozzle clogging can be prevented, and ejection of the ink-jet heads 16*c* to 16*k* can be stabilized. Various effects, including downsizing of the printing device 10 and improvement in safety, can also be obtained.

In this case, as described above, the medium 50 may be heated by using the preheater 20, the after heater 22, and the like at a position sufficiently distant from the ink-jet heads 16*c* to 16*k*. Also in this case, by using the ultraviolet ray irradiation unit 18, printing can be appropriately performed without performing heating at a high temperature with the preheater 20 or the after heater 22. In this case, the preheater 20 and the after heater 22 can be considered to be an example of a heater arranged at a position not opposed to the ink-jet heads 16*c* to 16*k*.

A further modification of the configuration of the printing device 10 can be considered. For example, mainly described in the above description is a configuration in a case of using the ink-jet heads 16*c* to 16*k* that respectively eject ink of CMYK colors. However, as the ink used for printing, ink of color other than CMYK may be used. In this case, for example, ink of special color may be further used in addition to the ink of CMYK colors. In this case, an ink-jet head that ejects ink for special color may be further used and arranged in the conveying direction together with the ink-jet heads 16*c* to 16*k*. As the ink, for example, clear ink and the like not containing a color material (coloring agent) may be used. Also in these cases, the ink can be appropriately dried by applying ultraviolet rays by the ultraviolet ray irradiation unit 18 immediately after the ink of respective colors is ejected.

Mainly described in the above description is the configuration in a case of using ultraviolet rays as energy rays for drying the ink. However, in a further modification of the configuration of the printing device 10, energy rays other than ultraviolet rays may be used. More specifically, in this case, for example, infrared rays may be used as energy rays. In this case, the ink contains an infrared ray absorber that absorbs infrared rays as an energy ray absorber. The printing device 10 includes an energy irradiation module that applies infrared rays in place of the ultraviolet ray irradiation unit 18. Also with this configuration, the ink can be efficiently and appropriately heated.

The disclosure can be preferably applied to a printing device, for example.

What is claimed is:

1. A printing device that performs printing on a medium by using an ink-jet system, the printing device comprising:

a conveyance module, configured to convey the medium in a preset conveying direction;

an ink-jet head, configured to eject ink to the medium conveyed by the conveyance module; and an energy irradiation module, configured to apply predetermined energy rays, wherein a length of the ink-jet head in a width direction of the medium as a direction orthogonal to the conveying direction is larger than a width of a region to be printed on the medium in which printing is performed, the ink ejected by the ink-jet head is ink that contains a solvent and an energy ray absorber that generates heat by absorbing the energy rays, the ink being fixed to the medium by evaporating the solvent, and the energy irradiation module applies the energy rays to the ink adhering onto the medium to volatilize and remove at least part of the solvent contained in the ink.

2. The printing device according to claim 1, wherein the energy irradiation module applies ultraviolet rays as the energy rays, and the ink contains an ultraviolet ray absorber that absorbs ultraviolet rays as the energy ray absorber.

3. The printing device according to claim 2, wherein the energy irradiation module is an ultraviolet LED (UV LED).

4. The printing device according to claim 2, wherein the ink contains the ultraviolet ray absorber in a range from 0.05 to 2 weight %.

5. The printing device according to claim 1, wherein the energy irradiation module is arranged on a downstream side of the ink-jet head in the conveying direction to apply the energy rays to a portion moved to the outside of a region opposed to the ink-jet head on the medium.

6. The printing device according to claim 1, wherein the energy irradiation module irradiates the ink on the medium with the energy rays so that a continuous irradiation time of the energy rays for a same position on the medium is shorter than a thermal time constant of heat radiation of the medium.

7. The printing device according to claim 1, further comprising:

an upstream-side heater as a heater, configured to heat the medium on an upstream side of the ink-jet head in the conveying direction, wherein the upstream-side heater heats the medium so that the temperature of the medium falls within a preset range equal to or lower than 50° C.

8. The printing device according to claim 1, further comprising:

a downstream-side heater as a heater, configured to heat the medium on a downstream side of the energy irradiation module in the conveying direction, wherein the downstream-side heater heats the medium so that the temperature of the medium falls within a preset range from 30 to 100° C.

9. The printing device according to claim 8, wherein the energy irradiation module irradiates the ink on the medium with the energy rays to increase viscosity of the ink to be in a state in which bleeding does not occur even when the ink on the medium is brought into contact with ink of another color, and flattening of dots of the ink proceeds on the medium during a period in which the medium moves to a position of the downstream-side heater after the energy rays are applied.

10. The printing device according to claim 1, wherein the energy irradiation module is an irradiation module including a semiconductor element that generates the energy rays.

11. The printing device according to claim 1, comprising:

a plurality of the ink-jet heads; and a plurality of the energy irradiation modules, wherein the plurality of the ink-jet heads are arranged side by side in the conveying direction with a gap therebetween, and each of the plurality of the energy irradiation modules is arranged between the plurality of the ink-jet heads in the conveying direction.

12. The printing device according to claim 11, wherein printing is performed without heating the medium using a heating module other than the energy irradiation module in a range in which the plurality of the ink-jet heads are arranged side by side.

13. A printing method for performing printing on a medium using an ink-jet system, the method comprising:

conveying the medium in a preset conveying direction, and ejecting ink to the medium being conveyed with an ink-jet head, and irradiating ink adhering onto the medium with predetermined energy rays, wherein a length of the ink-jet head in a width direction of the medium as a direction orthogonal to the conveying direction is larger than a width of a region to be printed on the medium in which printing is performed, the ink ejected by the ink-jet head is ink that contains a solvent and an energy ray absorber that generates heat by absorbing the energy rays, the ink being fixed to the medium by evaporating the solvent, and at least part of the solvent contained in the ink is volatilized and removed by irradiating the ink adhering onto the medium with the energy rays.

* * * * *